US007106034B2

(12) United States Patent
Chien et al.

(10) Patent No.: US 7,106,034 B2
(45) Date of Patent: Sep. 12, 2006

(54) VOLTAGE REGULATOR CIRCUIT WITH A LOW QUIESCENT CURRENT

(75) Inventors: Hung Jen Chien, Hsin Chu (TW); Meng-Jyh Lin, Hsin Chu (TW)

(73) Assignee: Sunplus Technology Co., Ltd., Hsin-Chu (TW)

( * ) Notice: Subject to any disclaimer, the term of this patent is extended or adjusted under 35 U.S.C. 154(b) by 0 days.

(21) Appl. No.: 11/252,791

(22) Filed: Oct. 19, 2005

(65) Prior Publication Data

US 2006/0108993 A1 May 25, 2006

(30) Foreign Application Priority Data

Nov. 19, 2004 (TW) ..... 93135710 A

(51) Int. Cl.
*G05F 1/58* (2006.01)

(52) U.S. Cl. ..... 323/281

(58) Field of Classification Search ..... 323/265, 323/273, 274, 276, 280, 281, 282; 327/538, 327/540

See application file for complete search history.

(56) References Cited

U.S. PATENT DOCUMENTS 4,319,179 A * 3/1982 Jett, Jr. ..... 323/281
4,613,809 A * 9/1986 Skovmand ..... 323/268
4,906,913 A * 3/1990 Stanojevic ..... 323/303
5,889,393 A * 3/1999 Wrathall ..... 323/282
6,703,815 B1 * 3/2004 Biagi ..... 323/280
6,710,583 B1 * 3/2004 Stanescu et al. ..... 323/280
6,806,690 B1 * 10/2004 Xi ..... 323/273
6,842,068 B1 * 1/2005 Perrier et al. ..... 327/540
6,960,907 B1 * 11/2005 Poss ..... 323/316
6,979,984 B1 * 12/2005 Perrier et al. ..... 323/281

* cited by examiner

*Primary Examiner*—Adolf Berbane
(74) *Attorney, Agent, or Firm*—Birch, Stewart, Kolasch & Birch, LLP

(57) ABSTRACT

A voltage regulator circuit with a low quiescent current for generating a stable output voltage includes a standby mode controller for generating an enable signal according to a standby signal, a reference voltage generator for receiving an operation voltage and generating a reference voltage, an amplifier for receiving the reference voltage and the output voltage and generating an amplified voltage, and a switch unit for receiving the operation voltage and generating the output voltage at an output terminal. The enable signal is kept enabled when the standby signal is disabled, and the enable signal is periodically enabled when the standby signal is enabled. The amplifier works only when the enable signal is enabled. The switch unit is controlled by the enable signal, and is turned on only when the enable signal is enabled. So, the quiescent current of the voltage regulator circuit in the standby mode can be greatly reduced.

9 Claims, 5 Drawing Sheets

VOLTAGE REGULATOR CIRCUIT WITH A LOW QUIESCENT CURRENT

This application claims the benefit of the filing date of Taiwan Application Ser. No. 093135710, filed on Nov. 19, 2004, the content of which is incorporated herein by reference.

BACKGROUND OF THE INVENTION

1. Field of the Invention

The invention relates to a voltage regulator circuit, and more particularly to a voltage regulator circuit for controlling operations of internal elements of the voltage regulator circuit according to a periodic control signal so as to reduce the quiescent current.

2. Description of the Related Art

A voltage regulator circuit is adopted to provide a stable output voltage. FIG. 1 shows a basic architecture of a conventional voltage regulator circuit. Referring to FIG. 1, the voltage regulator circuit 10 includes a reference voltage generator 11, an error amplifier 12, a switch unit (pass element) 13, resistors R1 and R2, and a capacitor C1. The reference voltage generator 11 generates a constant reference voltage Vref as a reference voltage of the error amplifier 12. Meanwhile, the output voltage Vout of the voltage regulator circuit 10 is converted into another feedback voltage Vfb by way of the voltage-dividing principle (Equation (1)). At this time, the error amplifier 12 receives the two voltages, and generates a computed voltage in order to control the switch unit (e.g., MOS, Bipolar, etc.). Therefore the voltage regulator can provide a desired current suitable for the load. After the computation of the overall loop, the voltage regulator circuit finally obtains a stable output voltage, which is calculated according to Equation (2).

$$Vfb=Vout*[R2/(R1+R2)] \quad (1)$$

$$Vout=Vref*[1+(R1/R2)] \quad (2)$$

However, this basic voltage regulator circuit 10 has DC quiescent currents including a quiescent current (Iref) of the reference voltage generator 11, a quiescent current (Iop) of the error amplifier 12 and a quiescent current (Idrive) of the load. Thus, when the voltage regulator circuit 10 is kept at a no-loading state (Iload=0), the system enters a so-called standby mode, and the quiescent currents Iref and Iop still exist at the input terminal (Vin) of the voltage regulator circuit 10. Therefore, if the system power is provided by a battery, the demands of reducing the quiescent current and lengthening the battery life cannot be achieved.

SUMMARY OF THE INVENTION

It is therefore an object of the invention to provide a voltage regulator circuit with a low quiescent current.

To achieve the above-identified object, the invention provides a voltage regulator circuit with a low quiescent current. The voltage regulator circuit includes a standby mode controller for receiving a standby signal and generating an enable signal according to the standby signal, a reference voltage generator for receiving an operation voltage and generating a reference voltage, an amplifier for receiving the reference voltage and the output voltage and generating an amplified voltage, and a switch unit for receiving the operation voltage and generating the output voltage at an output terminal. The enable signal is kept enabled when the standby signal is disabled, and the enable signal is periodically enabled when the standby signal is enabled. The amplifier works only when the enable signal is enabled. The switch unit is controlled by the enable signal, and is turned on only when the enable signal is enabled. So, the quiescent current of the voltage regulator circuit in the standby mode can be greatly reduced.

DETAILED DESCRIPTION OF THE INVENTION

The voltage regulator circuit of the invention with a low quiescent current will be described with reference to the accompanying drawings.

Figure 2:
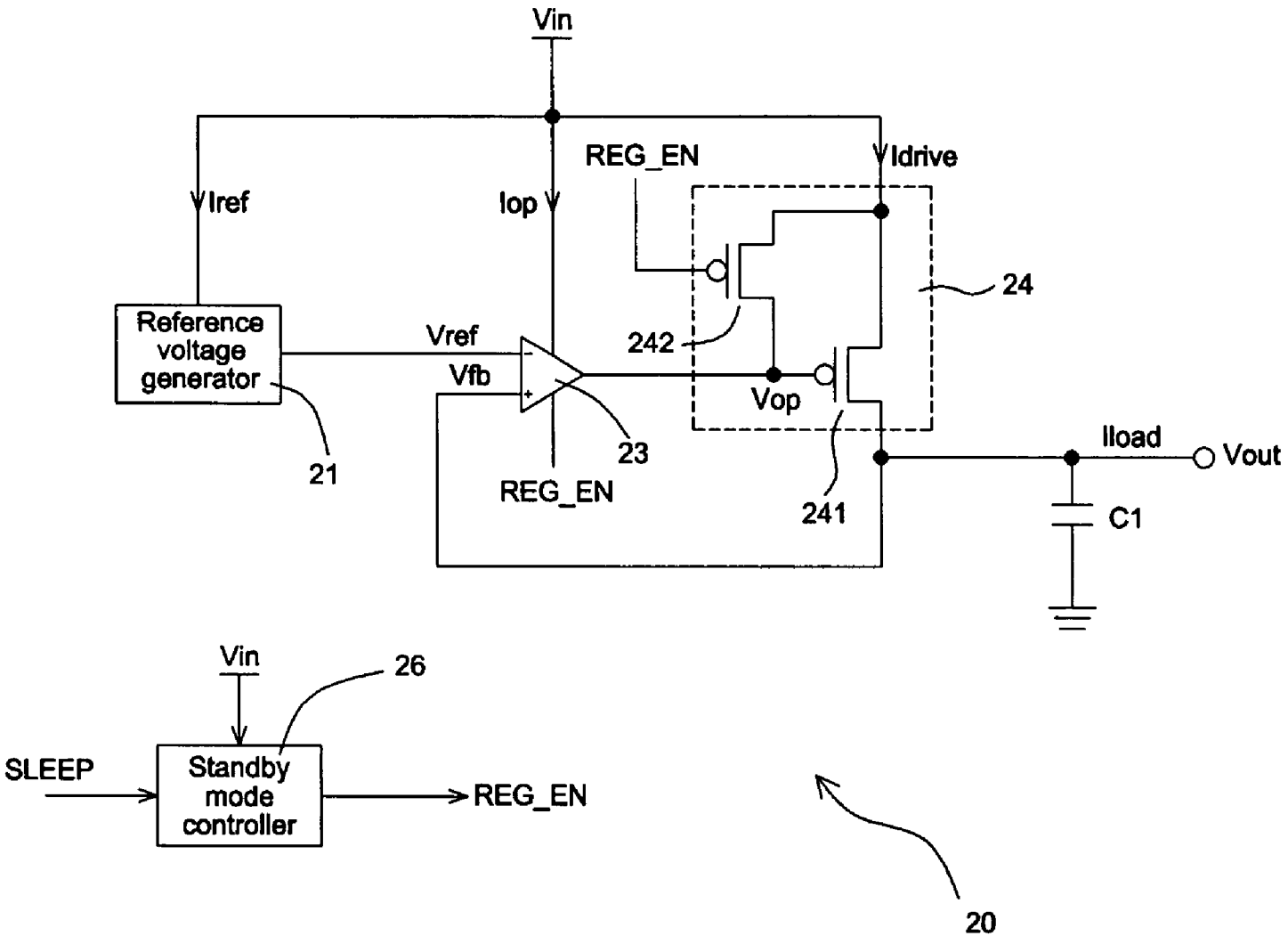
FIG. 2 shows a voltage regulator circuit with a low quiescent current according to a first embodiment of the invention.

FIG. 2 shows a voltage regulator circuit with a low quiescent current according to a first embodiment of the invention. Referring to FIG. 2, the voltage regulator circuit 20 with a low quiescent current includes a reference voltage generator 21, an error amplifier 23, a first switch unit 24, a capacitor C1 and a standby mode controller 26.

Figure 1:
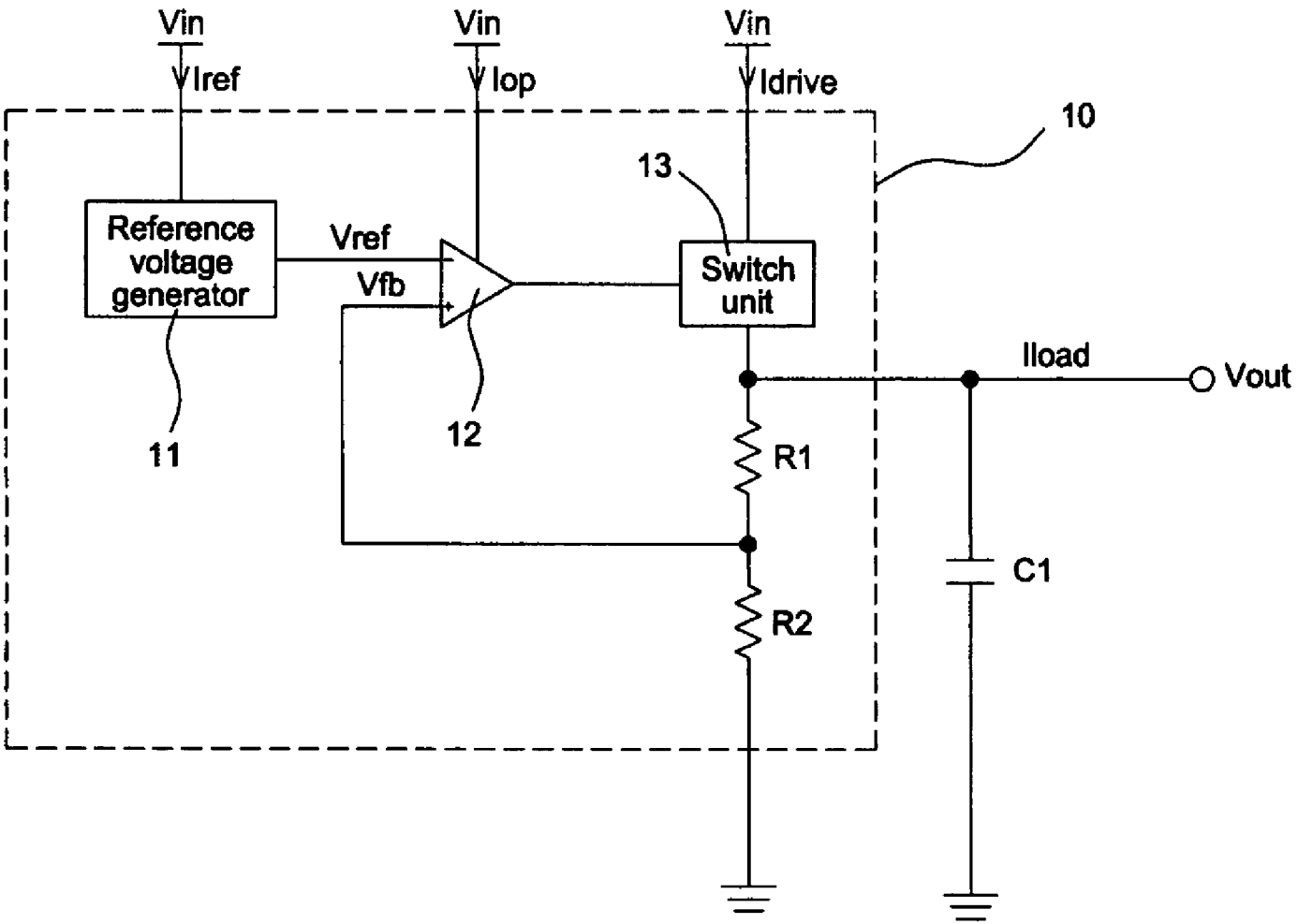
FIG. 1 (PRIOR ART)
FIG. 1 shows a basic architecture of a conventional voltage regulator circuit.

The reference voltage generator 21 and the conventional reference voltage generator 11 of FIG. 1 have the same function for generating a constant reference voltage Vref as a reference voltage of the error amplifier 23. The error amplifier 23 receives the reference voltage Vref and a feedback voltage Vfb, and then generates a control voltage Vop to control the first switch unit 24 to provide a desired current suitable for the load. The feedback voltage Vfb of this embodiment equals the output voltage Vout. The error amplifier 23 further receives a first enable signal REG_EN, and the error amplifier 23 works only when the first enable signal REG_EN is enabled. Consequently, when the first enable signal REG_EN is not enabled, the error amplifier 23 does not consume DC current.

The first switch unit 24 receives the control voltage Vop outputted from the error amplifier 23 and the ON/OFF state of the first switch unit 24 is controlled according to the first enable signal REG_EN. That is, when the first enable signal REG_EN is not enabled, the first switch unit 24 is off; and when the first enable signal REG_EN is enabled, the current flowing through the first switch unit 24 is controlled according to the control voltage Vop. The capacitor C1 is connected to the output terminal of the first switch unit 24 in order to stabilize the output voltage Vout. The first switch unit 24 of this embodiment is composed of two switch elements (e.g., MOS transistors) 241 and 242. Of course, other switch units capable of achieving the same function also may be used in this invention.

Figure 3:
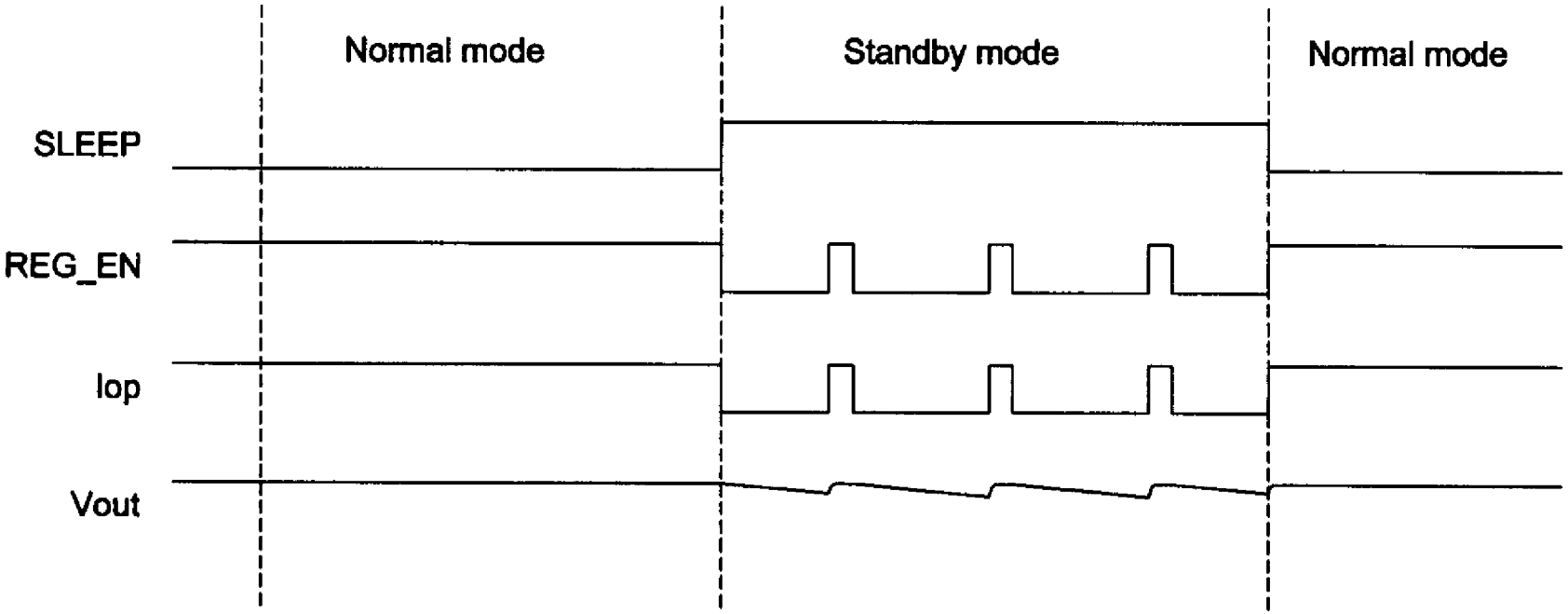
FIG. 3 shows timing charts of a standby signal SLEEP, a first enable signal REG_EN, an error amplifier DC current Iop and an output voltage Vout, which are applied to the voltage regulator circuit 20 of FIG. 2.

The standby mode controller 26 receives a standby signal SLEEP and generates the first enable signal REG_EN according to the standby signal. FIG. 3 shows timing charts of the standby signal SLEEP, the first enable signal REG_EN, the error amplifier DC current Iop and the output voltage Vout, which are applied to the voltage regulator circuit 20 of FIG. 2. As shown in FIG. 3, when the standby signal SLEEP is enabled (at a high logic level in this embodiment), the first enable signal REG_EN outputted from the standby mode controller 26 is a periodic pulse signal. The duty cycle of the periodic pulse signal may be configured according to the capacitance of the capacitor C1 and the power consumption of other elements in the standby mode. That is, the duty cycle is configured such that the output voltage Vout cannot be lower than a voltage threshold value, which is the minimum voltage for driving the other elements.

As shown in FIG. 3, when the system is in the normal mode, the first enable signal REG_EN is enabled (at a high logic level in this embodiment). So, the error amplifier 23 and the first switch unit 24 work normally such that the output voltage Vout is kept stable. When the system is changed to the standby mode, the standby signal SLEEP is enabled and then the first enable signal REG_EN is changed into the periodic pulse signal. Because the error amplifier 23 and the first switch unit 24 work only when the first enable signal REG_EN is at the high logic level (enabled), the error amplifier only consumes the DC current lop sometimes, thereby reducing the standby (static) DC quiescent current of the voltage regulator circuit 20. The reducing level of the standby DC quiescent current is determined according to the duty cycle of the first enable signal REG_EN in the standby mode.

Figure 4:
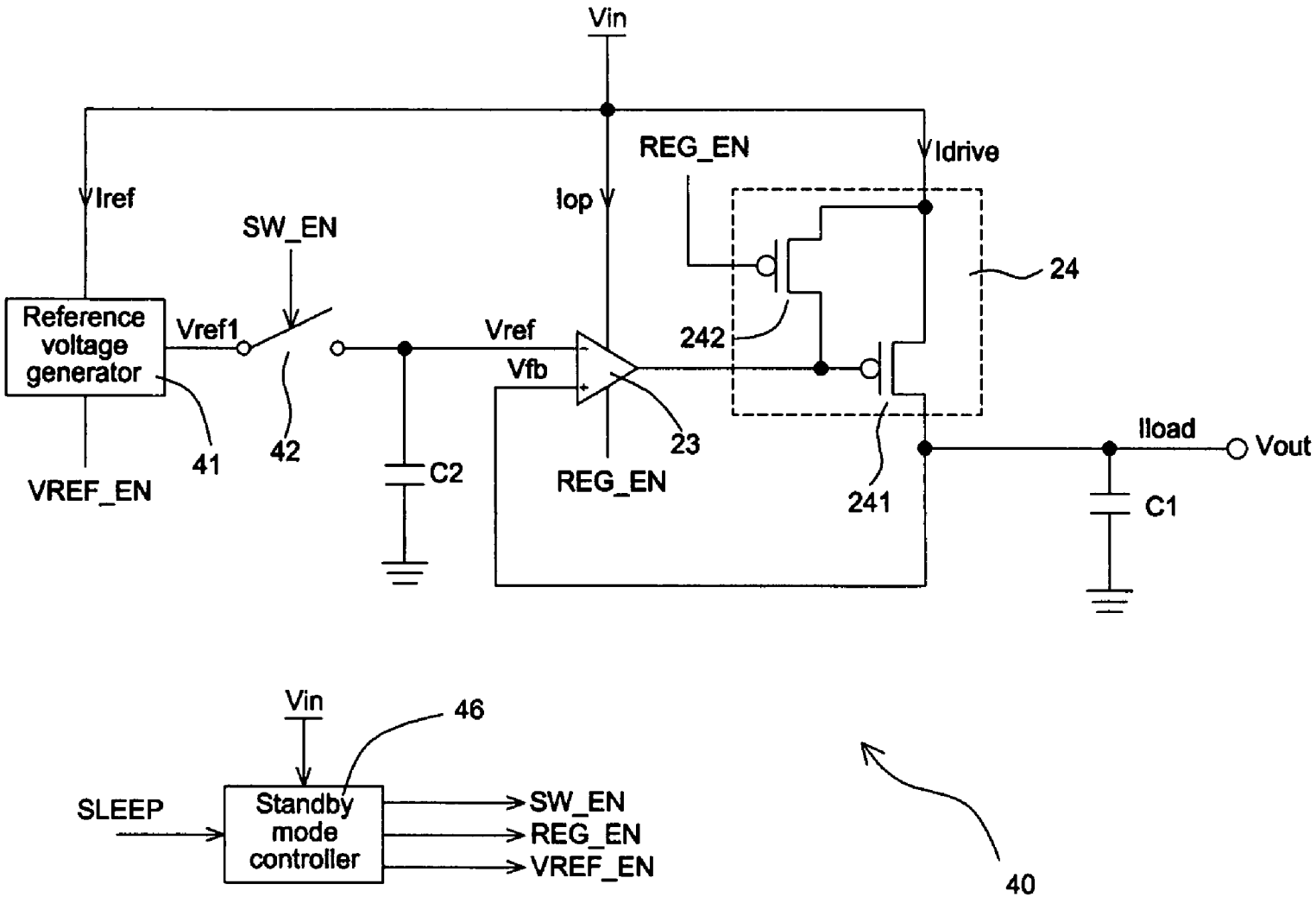
FIG. 4 shows a voltage regulator circuit with a low quiescent current according to a second embodiment of the invention.

FIG. 4 shows a voltage regulator circuit with a low quiescent current according to a second embodiment of the invention. Referring to FIG. 4, the voltage regulator circuit 40 of the invention with a low quiescent current includes a reference voltage generator 41, a first switch unit 24, a second switch unit 42, an error amplifier 23, capacitors C1 and C2, and a standby mode controller 46. The difference between the voltage regulator circuit 40 of the second embodiment and the voltage regulator circuit 20 of the first embodiment is that the second switch unit 42 and the capacitor C2 are added, and the reference voltage generator 41 and the second switch unit 42 are respectively controlled by a second enable signal VERF_EN and a third enable signal SW_EN in the second embodiment. The architectures and functions of the error amplifier 23, the first switch unit 24 and the capacitor C1 are the same as those in the voltage regulator circuit 20 of the first embodiment, and detailed descriptions thereof will be omitted.

The reference voltage generator 41 and the conventional reference voltage generator 21 of FIG. 2 have the same function for generating a constant reference voltage Vref as a reference voltage of the error amplifier 23. The difference is that the reference voltage generator 41 is further controlled by the second enable signal VERF_EN. The second enable signal VERF_EN is a periodic clock signal. The reference voltage generator 41 works only when the second enable signal VERF_EN is high and does not work when the second enable signal VERF_EN is low such that the DC quiescent current of the reference voltage generator 41 may be reduced.

The second switch unit 42, which is coupled between the reference voltage generator 41 and the error amplifier 23, controls whether or not the output voltage Vrefl of the reference voltage generator 41 is to be outputted to the error amplifier 23. The second switch unit 42 is controlled by the third enable signal SW_EN, which is a periodic clock signal having the same frequency as the second enable signal VERF_EN, a delayed phase lagging behind that of the second enable signal VERF_EN, and a duty cycle smaller than that of the second enable signal VERF_EN.

Figure 5:
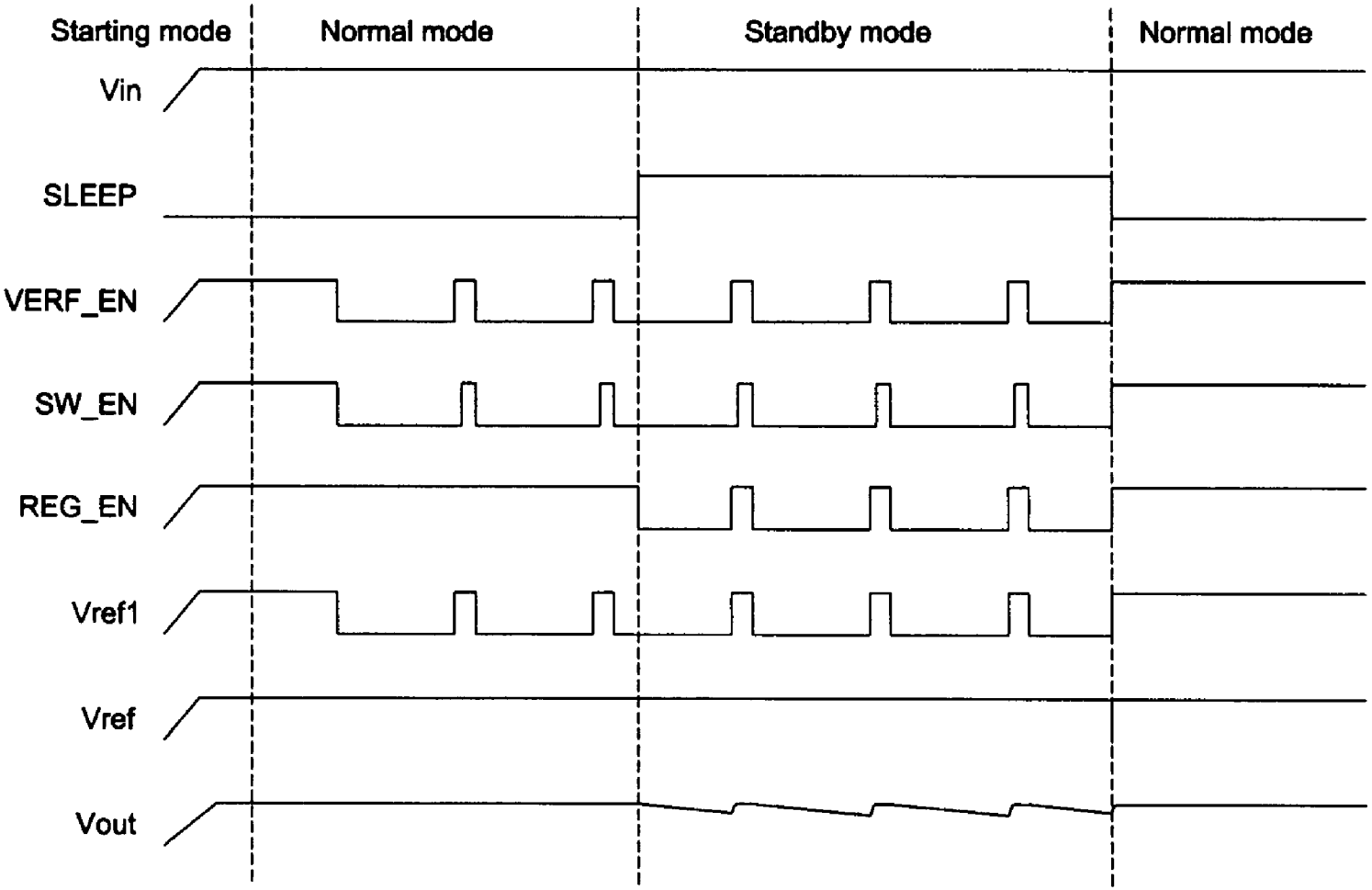
FIG. 5 shows timing charts of an input voltage Vin, a standby signal SLEEP, a first enable signal REG_EN, a second enable signal VERF_EN, a third enable signal SW_EN, an error amplifier DC current Iop and an output voltage Vout, which are applied to the voltage regulator circuit 40 of FIG. 4.

The standby mode controller 46 receives a standby signal SLEEP and generates the first enable signal REG_EN, the second enable signal VERF_EN and the third enable signal SW_EN according to the standby signal. FIG. 5 shows timing charts of the input voltage Vin, the standby signal SLEEP, the first enable signal REG_EN, the second enable signal VERF_EN, the third enable signal SW_EN, the error amplifier DC current lop and the output voltage Vout, which are applied to the voltage regulator circuit 40 of FIG. 4.

As shown in FIG. 5, when the standby signal SLEEP is enabled (at a high logic level in this embodiment), the first enable signal REG_EN outputted from the standby mode controller 46 is a periodic pulse signal. The duty cycle of the periodic pulse signal may be configured according to the capacitance of the capacitor C1 and the power consumption of other elements in the standby mode. That is, the duty cycle is configured such that the output voltage Vout cannot be lower than a voltage threshold value, which is the minimum voltage for driving the other elements.

As shown in FIG. 5, when the system is in the normal mode, the first enable signal REG_EN is enabled (at a high logic level in this embodiment). So, the error amplifier 23 and the first switch unit 24 work normally such that the output voltage Vout is kept stable. When the system is changed to the standby mode, the standby signal SLEEP is enabled and then the first enable signal REG_EN is changed into the periodic pulse signal. Because the error amplifier 23 and the first switch unit 24 work only when the first enable signal REG_EN is at the high logic level (enabled), the error amplifier only consumes the DC current lop sometimes, thereby reducing the standby (static) DC quiescent current of the voltage regulator circuit 40. The reducing level of the standby DC quiescent current is determined according to the duty cycle of the first enable signal REG_EN in the standby mode.

In addition, the second enable signal VERF_EN and the third enable signal SW_EN are periodic clock signals when the voltage regulator circuit 40 is in either the normal mode or the standby mode. Because the voltage regulator circuit 40 utilizes the capacitor C2 to hold the voltage Vref at the input terminal of the error amplifier 23, the reference voltage generator 41 and the second switch unit 42 need not to always be held at the working state, and the voltage of the capacitor C2 may be held by the periodic operation. In addition, because the impedance at the input terminal of the error amplifier 23 is very large, the capacitor C2 may also be held at the stable voltage even if the capacitor C2 is charged sometimes. In this invention, because the reference voltage generator 41 and the second switch unit 42 only work periodically or sometimes, the DC quiescent current of the reference voltage generator 41 may be greatly reduced.

Furthermore, because the reference voltage generator 41 cannot output a stable reference voltage until a period of time has been elapsed after the second enable signal VERF_EN becomes the high logic level, the phase of the third enable signal SW_EN lags behind that of the second enable signal VERF_EN, and the duty cycle of the third enable signal SW_EN is also smaller than that of the second enable signal VERF_EN, such that the capacitor C2 may keep the stable voltage.

As shown in FIG. 5, the second enable signal VERF_EN and the third enable signal SW_EN are periodic clock signals in either the normal mode or the standby mode. When the system is just started, however, the second enable signal VERF_EN and the third enable signal SW_EN are kept enabled (at a high logic level in this embodiment) in order to charge the capacitor C2 to the desired voltage rapidly. That is, the second enable signal VERF_EN and the third enable signal SW_EN are kept enabled when the system is in the starting mode such that the capacitor C2 may be charged to the desired voltage rapidly.

Although the voltage regulator circuit with the low quiescent current in this invention further adds a standby mode controller 26(46) for generating the enable signal, the power consumption of the standby mode controller 26(46) is far smaller than that of the reference voltage generator, the error amplifier and the first switch unit. Thus, the quiescent current of the voltage regulator circuit of this invention is far smaller than that of the prior art voltage regulator circuit.

In the first embodiment, for example, if the standby mode controller consumes about A1 microamperes (uA), the error amplifier consumes about A2 microamperes, and the duty cycle of the first enable signal REG_EN may be set as X, then the ratio of the DC quiescent current that can be reduced in the standby mode is:

$$[A2-(A1+A2*X)]/A2*100\%.$$

In the second embodiment, if the standby mode controller consumes about A1 microamperes, the error amplifier consumes about A2 microamperes, the reference voltage generator consumes about A3 microamperes, the duty cycle of the first enable signal REG_EN may be set as X, and the duty cycles of the second enable signal VERF_EN and the third enable signal SW_EN may be set as Y, then the ration of the DC quiescent current that can be reduced in the standby mode is:

$$[(A2+A3)-(A1+A2*X+A3*Y)]/(A2+A3)*100\%.$$

The ratio of the DC quiescent current that can be reduced in the normal mode is:

$$[(A2+A3)-(A1+A2+A3*Y)]/(A2+A3)*100\%.$$

For example, when A1=2 microamperes, A2=5 microamperes, A3=30 microamperes, X=1/256 and Y=1/256, the ratio of the DC quiescent current that can be reduced in the standby mode is 93.8%, and the ratio of the DC quiescent current that can be reduced in the normal mode is 79.6%.

While certain exemplary embodiments have been described and shown in the accompanying drawings, it is to be understood that such embodiments are merely illustrative of and not restrictive on the broad invention, and that this invention not be limited to the specific construction and arrangement shown and described, since various other modifications may occur to those ordinarily skilled in the art.

What is claimed is:

1. A voltage regulator circuit comprising:

a standby mode controller for receiving a standby signal and generating a first enable signal according to the standby signal, wherein the first enable signal is kept enabled when the standby signal is disabled and the first enable signal is periodically enabled when the standby signal is enabled;

a reference voltage generator for receiving an operation voltage and generating a reference voltage;

an amplifier for receiving the reference voltage and a stable output voltage and generating an amplified voltage, wherein the amplifier works only when the first enable signal is enabled; and a first switch unit for receiving the operation voltage and generating the stable output voltage at an output terminal, wherein the first switch unit is controlled by the first enable signal, and turned on when the first enable signal is enabled.

2. The voltage regulator circuit according to claim 1, further comprising a first capacitor, which is connected to the output terminal of the first switch unit in order to stabilize the output voltage.

3. The voltage regulator circuit according to claim 2, wherein the standby mode controller further receives the operation voltage and enables the first enable signal when the operation voltage is not stable.

4. The voltage regulator circuit according to claim 2, further comprising:

a second switch unit connected between the reference voltage generator and the amplifier and controlled by the first enable signal; and a second capacitor connected to an output terminal of the second switch unit so as to stabilize a voltage at the output terminal of the second switch unit, wherein the second switch unit is turned on when the first enable signal is enabled.

5. The voltage regulator circuit according to claim 4, wherein the reference voltage generator further receives the first enable signal and works only when the first enable signal is enabled such that the quiescent current of the voltage regulator circuit can be reduced.

6. The voltage regulator circuit according to claim 2, wherein the reference voltage generator further receives a second enable signal and works only when the second enable signal is enabled.

7. The voltage regulator circuit according to claim 6, further comprising:

a second switch unit connected between the reference voltage generator and the amplifier and controlled by a third enable signal; and a second capacitor connected to an output terminal of the second switch unit so as to stabilize a voltage at the output terminal of the second switch unit, wherein the second switch unit is turned on when the third enable signal is enabled.

8. The voltage regulator circuit according to claim 7, wherein the standby mode controller further generates the second enable signal and the third enable signal, both of which are kept enabled when the operation voltage is not stable and are periodically enabled when the operation voltage is stable.

9. The voltage regulator circuit according to claim 7, wherein the third enable signal and the second enable signal have the same frequency but a phase delay therebetween, and a duty cycle of the third enable signal is smaller than a duty cycle of the second enable signal.

* * * * *